United States Patent [19]

Bentson

[11] Patent Number: 4,630,311

[45] Date of Patent: Dec. 16, 1986

[54] ZIPPER-LOCK BAG CHAIN WITH TEARABLE STRIP INTERCONNECTION MEANS

[75] Inventor: Per Bentson, Suffern, N.Y.

[73] Assignee: Minigrip, Inc., Orangeburg, N.Y.

[21] Appl. No.: 676,085

[22] Filed: Nov. 29, 1984

[51] Int. Cl.[4] ..... B65D 30/00

[52] U.S. Cl. ..... 383/37; 206/820; 383/63; 493/198

[58] Field of Search ..... 383/37, 63, 65; 206/526, 554, 820; 493/198

[56] References Cited

U.S. PATENT DOCUMENTS

| | | | |
|---|---|---|---|
| 3,199,671 | 8/1965 | Dary | 206/526 X |
| 3,246,672 | 4/1966 | Naito | 383/63 X |
| 3,358,821 | 12/1967 | Weisberg | 383/37 |
| 3,559,874 | 2/1971 | Titchenal | 383/37 X |
| 3,618,286 | 11/1971 | Membrino | 383/37 X |
| 3,679,127 | 7/1972 | Stefancin | 383/6 X |
| 3,699,746 | 10/1972 | Titchenal et al. | 383/37 X |
| 3,744,211 | 7/1973 | Titchenal et al. | 383/65 X |
| 3,791,573 | 2/1974 | Titchenal et al. | 383/37 X |
| 3,941,306 | 3/1976 | Weikert | 383/37 |
| 4,191,230 | 3/1980 | Ausnit | 383/65 X |
| 4,278,198 | 7/1981 | Norton et al. | 383/9 X |
| 4,490,959 | 1/1985 | Lewis | 53/459 |
| 4,523,918 | 6/1985 | Ausnit | 493/198 |
| 4,558,556 | 12/1985 | Jostler | 53/459 |
| 4,584,706 | 4/1986 | Ausnit | 383/37 |

*Primary Examiner*—William Price
*Assistant Examiner*—Bryon Gehman
*Attorney, Agent, or Firm*—Hill, Van Santen, Steadman & Simpson

[57] ABSTRACT

A chain of laterally spaced interconnected bags with each bag having individual releasably interlocking rib and groove element which are laterally spaced on confronting inner faces at the top and with each being closed by a side seam at each side. A strip is attached or is integral along the top edge or bottom edge of the chain and is removable by a series of perforations through the material so that removal separates the bags from the chain.

17 Claims, 8 Drawing Figures

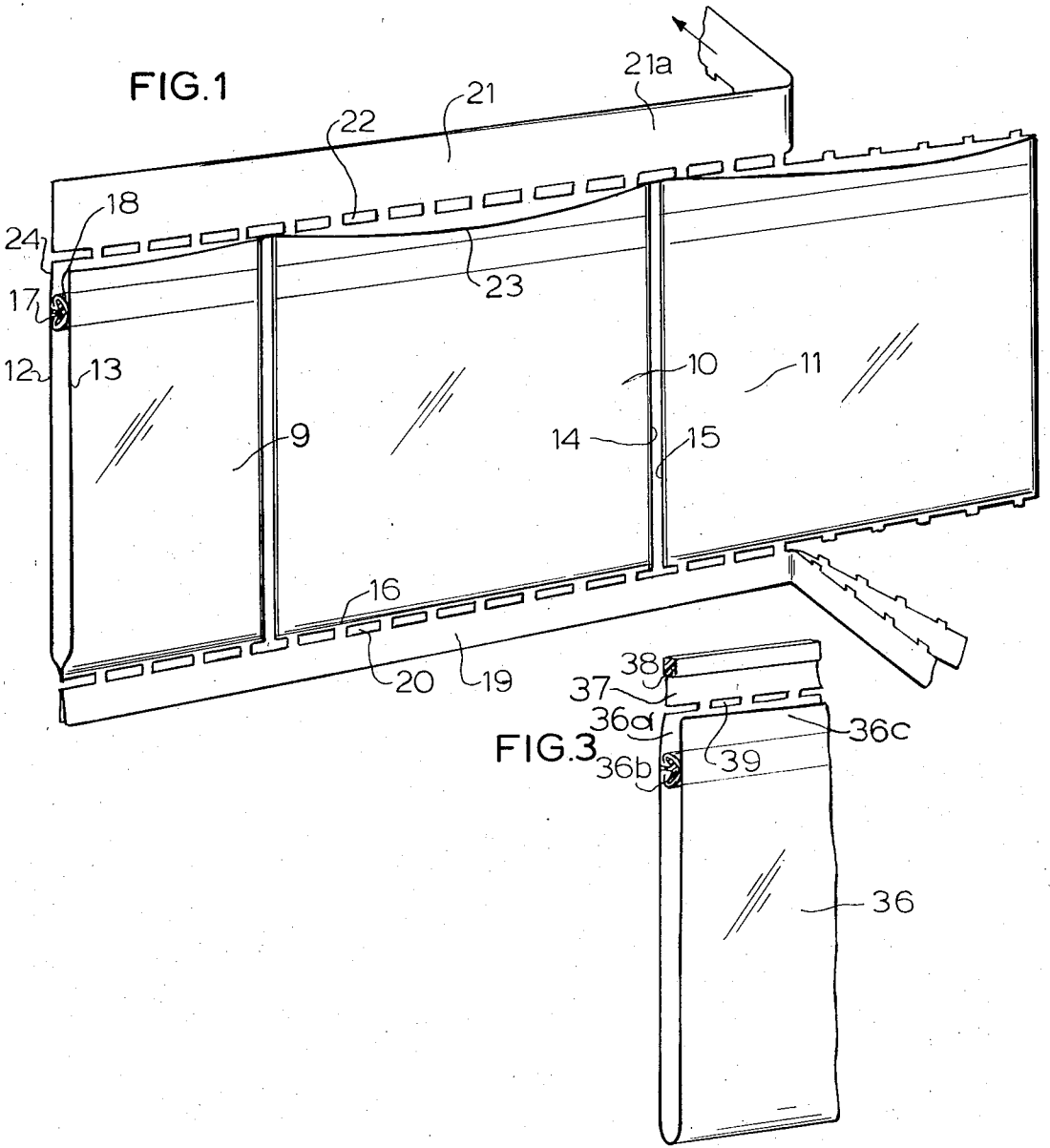
FIG. 1
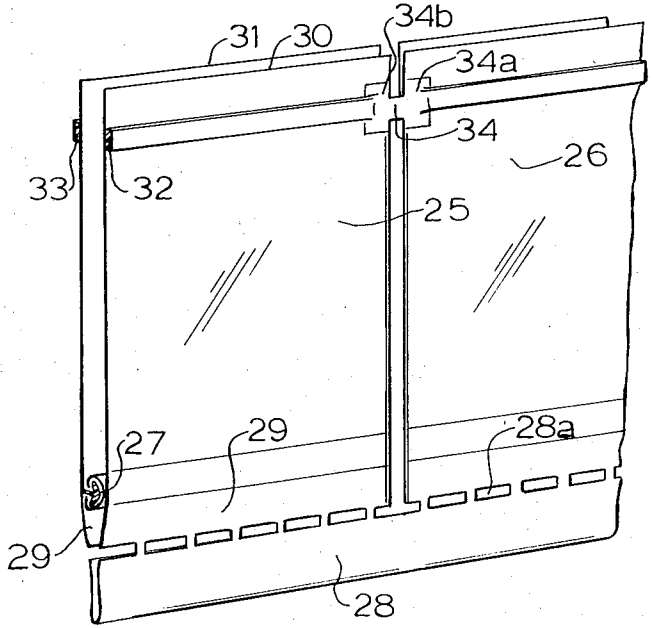
FIG. 2
FIG. 3
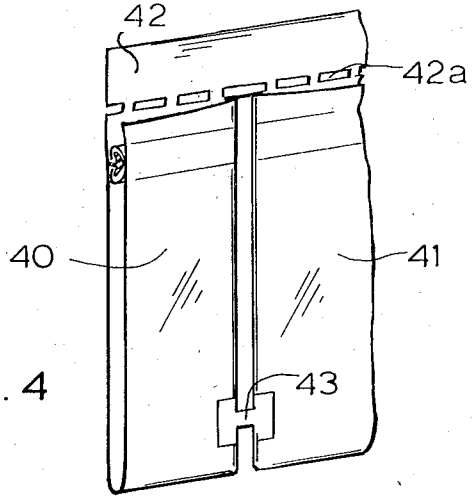
FIG. 4

ZIPPER-LOCK BAG CHAIN WITH TEARABLE STRIP INTERCONNECTION MEANS

BACKGROUND OF THE INVENTION

The present invention relates to improvements in plastic bags and method of making plastic bags formed in a continuous bag chain where adjacent bags are joined by an interconnection and wherein the bags can be separated either manually or by a machine operation during an automatic filling procedure.

The bags which are involved are thin plastic film bags which have sides and a bottom edge and a the upper end have a reclosable zipper lock structure. The zipper lock structure constitutes a set of interlocking rib and groove profiles. The lock structure is closable and the bag is closed by applying an opposed closure pressure progressively along the length of the profile elements. The lock structure and the bag is opened when the profiles are separated by either drawings them apart, such as by pulling flaps which extend above the profiles laterally or by longitudinal movement of one profile relative to another in such a manner that the profiles snap apart. Reclosable bags of the type described are disclosed, for example, in U.S. Pat. Nos. re 28,969, 3,338,284 and Re 29,208.

In the manufacture of bags of the above type, they are typically made by the plastic being continuously extruded from a circular die to form an endless profile tube. However, the bags can be made from a folded flat film with interlocking profiles adjacent either end with said profiles either attached integrally or separately attached. In other words, the profiles can be formed integrally with the material of the bag or may be on strips which are then secured to the bag material. In the tubular form, the mating interlocking profiles are formed on the inner surface of the tube. The profiles are joined when the plastic has cooled sufficiently to eliminate distortion of the plastic. Subsequently, individual bags are formed by cross-seals at spaced intervals to form a seam at each of the side edges of each of the bags with the bags being simultaneously cut from the tube at said seam.

In one commercially advantageous form, the bags are manufactured and are stored to be sold and shipped to the user who opens, fills and recloses the individual bags. These bags may be stacked in boxes, but in one preferred form, the bags are interconnected to each other in strip or chain form with individual bags torn off of the supply strip. This form of chain of bags is advantageously utilized in automatic filling and handling machines, and one arrangement for utilizing such a chain of bags is disclosed in the copending application, Ser. No. 429,617, now U.S. Pat. No. 4,490,959 issued Jan. 1, 1985 where automatic machinery has been devised for feeding, opening, and reclosing the reclosable bags. Such mechanism utilizes a series of interconnected bags drawing them along a travel path through work stations of the machine. At one section of the machine, the individual bags are removed from the supply chain by being forcibly torn from the chain. Whether torn from the chain or otherwise disconnected, a relatively high speed production operation can occur by pulling the chain of bags from a supply source, either a roll or a box and having individual bags disconnected from the chain as they are handled by the machine.

A significant feature of providing such a chain of bags is that the formation of the chain or interconnection of the bag be done simply without interfering with the manufacturing operation and without adversely affecting the strength and appearance of the bag. Also, whether the bags are forcibly torn from each other, or the interconnecting means is broken or separated by other arrangements as will be described herein, the bags must be separated without damage to them, and also separated rapidly and easily without slowing the high speed operation of the filling and closing machine.

It is accordingly an object of the present invention to provide an improved method and bag chain wherein individual bags can be supplied in a chain and removed from the chain readily and easily and uniformly without endangering the integrity of the bags.

A still further object of the invention is to provide an improved bag chain structure wherein the bags are reliably and simply attached to each other and are easily and readily removed from the chain.

A further object of the invention is to provide an improved bag chain structure wherein the ease of separation of the bags can be controlled by the structure.

A still further object of the invention is to provide an improved structure for the attachment of bags to each other to form a continuous chain wherein the structure serves to accurately align the adjacent bags to each other maintaining the interlocking rib and groove elements and the top and bottom edges in alignment.

A feature of one form of the invention is to manufacture bags sequentially and provide a removable strip along one or both edges wherein the strip can be separated to sequentially release the bags such as by tearing the strip from the edge.

Another feature of the invention is accordance with another form, is to provide a frangible strip attached to the bags wherein the strip is laminated to the bag material in a surface-to-surface engagement so that it is reinforced over the area of attachment but frangible in the area between the bags thus permitting a strip of uniform weight to be used. The strip can be formed of clear material which does not interfere with the appearance of the bag or can be formed of a decorative material which contributes to the structure and function and appearance of the bags.

Other objects, advantages and features, as well as equivalent methods and structures, will become more apparent from the teaching of the principles of the invention in connection with the disclosure of the preferred embodiments in the specification, claims and drawings, in which:

DESCRIPTION OF THE DRAWINGS

FIG. 1 is a perspective view showing a section through one of a chain of bags constructed in accordance with the principles of the present invention;

FIG. 2 is a perspective view of another form of bag chain;

FIG. 3 is a fragmentary perspective view of another form of chain structure;

FIG. 4 is a perspective view of a further arrangement;

DESCRIPTION

Figure 6:
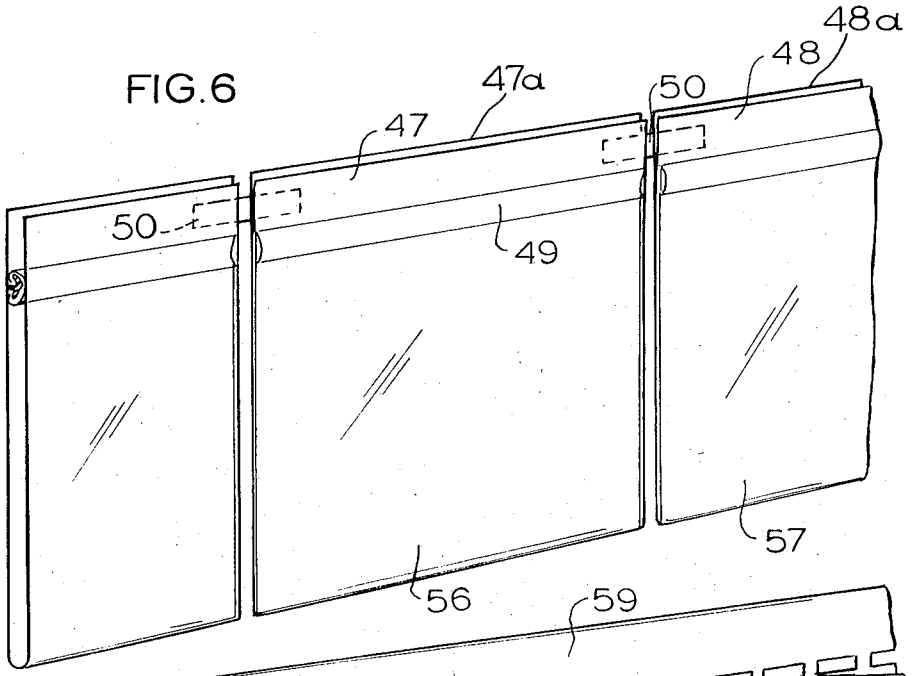
FIG. 6 is a perspective view of another form of bag arrangement.

FIG. 2 illustrates a chain of bags with the bags preferably formed of thin polyethylene material and attached to each other in a side-by-side relationship. Bags are shown at 10 and 11 having heat sealed side seams 14 and 15, and a cross section of the bag 9 is shown to illustrate sidewalls 12 and 13. The bottom is closed along a heat sealed seam 16.

Adjacent the top of the bag on confronting faces are pressure interlocking rib and groove elements 17 and 18. The rib and groove elements are separable in using the bag by pulling apart flanges 23 and 24 at the top of the bag. For purposes of interconnecting the bags in a continuous chain, a strip 19 which is a continuation of the bag walls 12 and 13 below the bottom seam 16, extends along the bottom of the bags and is perforated below said seam by perforations 20. The side seams 14 and 15 extend slightly beyond sealed seam 16 into the the perforations 20 so that when the strip 19 is torn along said perforations, the bags in the chain become separated.

At the top is a similar strip 21 which is a continuation of flange flap 24 and extends along the top of the bags and is perforated by perforations 22.

As will be apparent from the drawings, and in particular FIG. 1, each bag in the chain is fully separated from each adjacent bag by a line of separation which extends along and between the side seams 14 and 15 and past the ends of the rib and groove elements 17, 18 which end at the side seams. Above the rib and groove elements, the separation extends through the pullapart flanges 23 and 24 to the strip of material 21. Thereby, when the strip of material 21 is removed as indicated by the directional arrow, the bags will automatically separate from one another at the pullapart flanges 23 and 24 and the separated ends of the rib and groove elements and throughout at least the major extent of the separation below the rib and groove elements. In this instance, such separation is all the way to the strip 19 which is concurrently separated from the bags as indicated at the right side of FIG. 1 so that complete release of the bags from one another is attained.

Thus, when utilizing the bags, the individual connected bags after their rib and groove elements have been pulled apart, are filled and then the rib and groove elements are pressed together. The filled bags are then separated from the chain by tearing the strips 19 and 21 from the chain which release the individual bags from the chain. Until the strips are torn off, the bags are interconnected in a chain. It is also possible that the user may wish to fill the individual bags after they have been separated from the chain. In that case the bags will e released by tearing the strips off the chain and each bag will be released to be taken individually and filled when the strips are progressively torn from the chain. The strips 19 and 21 are preferably of material integral with the bag material.

In the arrangement of FIG. 2, bags 25 and 26 are shown interconnected into a chain. The bags are inverted and the rib and groove elements 27 are facing downwardly. The bottom edges of the bag, 30 and 31 (at the top in FIG. 2), remain unattached so that access to the interior of the bag is afforded for a filling machine.

Along the outer surfaces of the bag adjacent to the bottom edges 30 and 31 are ribs 32 and 33 which may be employed by a bag filling machine to support the bag. That is, the ribs have downwardly facing shoulders so that they can slide in recesses on the bag machine.

A double strip 28 has lines of perforations at **28*a* which may be torn off to separate the bags. An additional frangible connection link between the bags in the chain is shown at 34, but this may be omitted in some chain constructions where the bags are connected only by the double strip 28 each of which is a continuation of the respective bag walls. The link 34 may be formed by plastic softened by heat with the plastic supplied from the ribs 32 and 33 at 34*a* and 34*b*. When the strip 28 is torn off, flanges 29 remain for separating the rib and and groove elements 27**.

It may be noted that the frangible links 34 are divided into heat sealed areas **34*a* and 34*b* by cuts thereby reducing the size of the links 34 to a predetermined width which gives them the strength necessary to hold the bags in a chain, but the links 34** are breakable when the bags are pulled apart.

In machine handling of a bag chain such as shown in FIG. 2, the chain is pulled through a machine, the individual bags are filled between the separated edges 30 and 31, and the edges then joined by a heat seal. The individual completed filled bags are separated by being forcibly pulled from the chain and by tearing off the strip 28.

FIG. 3 illustrates another form of bag chain which may be utilized in a machine which has recesses to support the bag chain. The bags 36 of FIG. 3 have a rib 38 along the top. The rib is carried on a flap 37 which is integral with the flange **36*a*, but with perforations 39 extending between the flange 36*a* and flap 37. For filling the bag, the front flange 36*c* is pulled outwardly to separate rib and groove elements 36*b* and afford access to the bag. The rib and groove elements are then pressed together to close the top. When the top flap 37 is torn off the chain along the perforations 39**, individual bags are removed from the chain.

In FIG. 4 bags 40 and 41 of the chain are connected to each other by a tear strip 42 at the top and optionally additionally by a fracturable link 43 at the bottom of the bags. The link 43 is formed by a heat seal area which is reduced in width to afford the proper strength for attachment, but permit tearing. The strip 42 at the top has a line of perforations **42*a*** which can be torn to free the individual bags.

In FIG. 6, a chain of bags is formed with the bags interconnected by strips or attachment links laminated to the surface of the bag material. Adjacent bags 56 and 57 are attached to each other by small attachment strips 50 which are laminated to the surface of flaps such as front flaps 47 and 48 and rear flaps **47*a* and 48*a*. The strips 50 may be attached to either the front flaps 47 and 48 or the rear flaps 47*a* and 48*a*. If the bags are formed of material such as polyethylene, the links 50 may be formed of a small strip of polyethylene heat laminated to the surface area above the rib and groove profiles 49, and may be of a material lighter in weight than the bag material for facilitating tearing. Instead of being heat sealed, the links 50 may be adhesive backed. After the bags have been filled through the top and the ribs and grooves rejoined, a longitudinal pull is exerted on the end bag, and the link 50 connecting it to the next succeeding bag will break. The strip 50**, while being lightweight and frangible lends some stiffness to the flaps to which it is attached.

Figure 5:
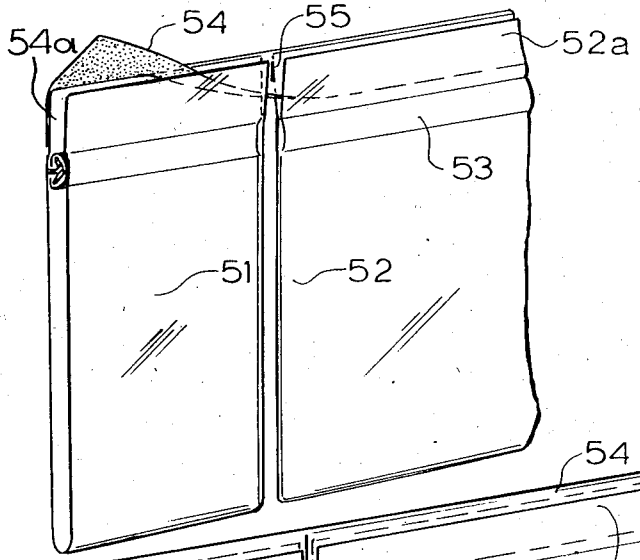
FIG. 5 is a perspective view illustrating removal of material for the use of the bag.
Figure 7:
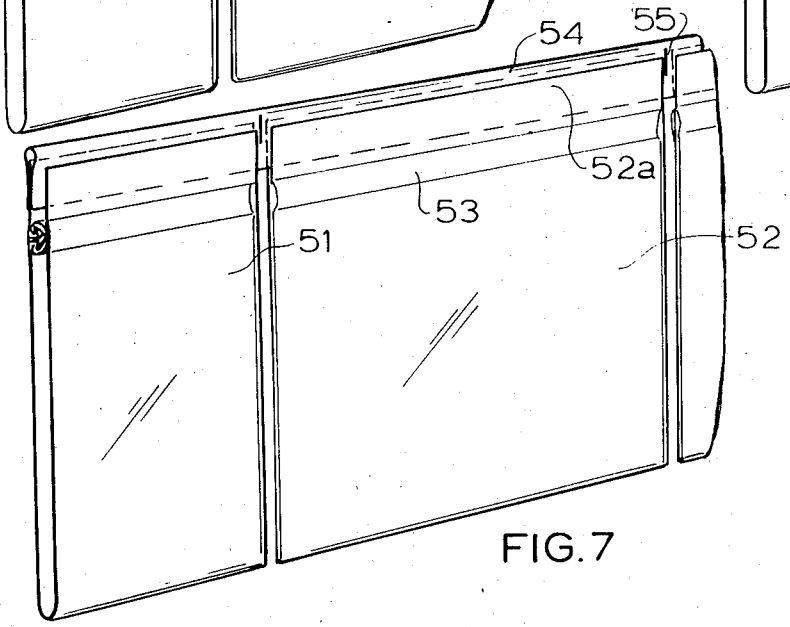
FIG. 7 is a perspective view of still another form of bag arrangement.

In the arrangement of FIGS. 5 and 7, adjacent bags 51 and 52 having rib and groove profiles 53 on their inner confronting surfaces are attached to each other by a continuous strip 54 which is doubled over the top of the back flap 54*a*. The doubled strip 54 may be laminated to the bag material or attached thereto by adhesive. The laminated strip 54 leaves free a front flap 52*a* which can be pulled forward for opening the bag for filling. The bags are then torn apart by a longitudinal pull on the chain wherein the strip 54 breaks at the location between the bags. For this purpose, it may be of a material weaker than the bag material. If desired, a cut 55 may be placed in the strip at the location between the bags with the cut being of a predetermined length to leave an area of the strip sufficient to connect the bags but to permit easy breakage.

As an alternate arrangement instead of the strip 54 being torn, it may be peeled off the top of the bag to separate individual bags such as when the bags are fed through a machine.

While only one attachment structure may be employed between bags, duplicate attachments may be used both at the top and the bottom of the bag. A combination of the different forms of links may be employed at the top and bottom depending upon the circumstances of use.

When a continuous attached strip is employed, such as that illustrated in FIGS. 1 and 2, this strip may be formed simultaneously with the manufacture of the bag which will normally be made by a single operation in being extruded from a die. Where interconnecting means are attached to the bag, such as with the arrangements shown in FIGS. 6 and 7, these may attached at the time the bags are cross-sealed.

Figure 8:
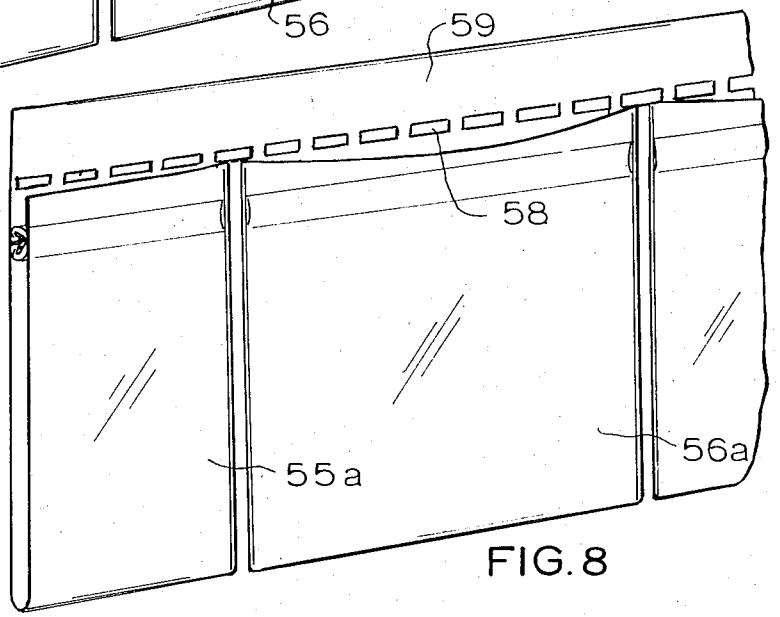
FIG. 8 is a perspective view of a further arrangement.

FIG. 8 illustrates a continuous chain of bags interconnected by a continuous integral strip 59, which is a continuation of the rear flange and rear bag wall. Adjacent bags 55*a* and 56*a* are separated at their side edges, but the upper ends of the bags are joined by the strip 59 which is perforated from the rear flange by perforations 58. For filling, the front flap of the bags may be pulled forwardly, similarly to the arrangement shown in FIG. 1, and when the bags are to be separated, the strip 59 will be torn off to separate the individual bags.

Thus, it will be seen that I have provided an improved method and structure for bag chains which is well suited for use in automatic bag handling machinery such as where the machinery pulls the bag chain from a supply source, opens, fills and recloses the bags. While separation will normally occur in the automatic machine, it may be done in a subsequent act by an eventual user.

The preferred arrangements in accordance with the principles of the invention have been shown and described herein, but it will be understood that equivalent structures and methods utilizing the principles of the invention may be employed.

I claim as my invention:

1. A chain of laterally interconnected bags comprising in combination:

a plurality of bags formed of a plastic film each having releasably interlocking rib and groove elements on confronting inner faces at the bag tops, immediately below and along upstanding pullaport flange means and each bag being closed by a side seam at each side edge and positioned in spaced side-by-side relationship to form a chain, said rib and groove elements having opposite ends at said side seams and spaced from the ends of the rib and groove elements of the adjacent bags;

strip material detachably connected to said flange means of the bags to form the chain and removable from the flange means for separating individual bags from the chain;

and each bag in the chain being fully separated from each adjacent bag by a line of separation which extends along and between said side seams and past said ends of said rib and groove elements and through said pullapart flange means all the way to said strip of material, so that when said strip of material is removed, the bags will automatically separate from one another at said pullapart flange means and the separated ends of the rib and groove elements and at least throughout the major extent of said separation below said rib and groove means.

2. A chain of laterally interconnected bags constructed in accordance with claim 1:

wherein said pullapart flange means comprises a pair of separable flanges and said strip is removably connected to only one of said flanges.

3. A chain of laterally interconnected bags constructed in accordance with claim 1:

wherein said strip material is continuous and coextensive with said pullapart flange means throughout the chain formed by the plurality of bags.

4. A chain of laterally interconnected bags constructed in accordance with claim 1:

wherein said strip material is integral with the material of the pullapart flange means and is attached thereto along a line of weakened resistance for manual separation from the chain formed by the plurality of bags.

5. A chain of laterally interconnected bags constructed in accordance with claim 4:

wherein said line of weakened resistance is formed by a plurality of perforations extending parallel to said chain.

6. A chain of laterally interconnected bags constructed in accordance with claim 1:

wherein said strip material extends along the chain at the top edge of said flange means.

7. A chain of laterally interconnected bags constructed in accordance with claim 1:

wherein another detachable line of strip material extends along the edge of the chain formed by the plurality of bags which is at the bottom of the bags.

8. A chain of laterally interconnected bags constructed in accordance with claim 1:

including a second means attaching the adjacent bags to each other at the bottom ends of the bags and being separable to permit separation of the bags.

9. A chain of laterally interconnected bags constructed in accordance with claim 1:

wherein said strip material extends along the chain formed by the plurality of bags and an enlarged thickened ridge extends along the bottom end portion of the bags for providing a support for the chain of bags when suspending the chain of bags from said ridge for filling or the like.

10. A chain of laterally interconnected bags constructed in accordance with claim 1:

wherein said strip material is laminated to a surface of the pullapart flange means.

11. A chain of laterally interconnected bags constructed in accordance wtih claim 1:

wherein said strip material is heat sealed to the pullapart flange means.

12. A chain of laterally interconnected bags constructed in accordance with claim 1:

wherein said strip material is attached to the pullapart flange means by an adhesive substance.

13. A chain of laterally interconnected bags according to claim 1:

wherein the bottom edges of the bags are separated for filling through the bottom;

and a strip of frangible material adjacent to said bottom edges extending laterally between each two adjacent bags.

14. A chain of laterally interconnected bags according to claim 1:

wherein the pullapart flange means comprise flaps above the fastener elements;

and said strip material comprises a strip of interconnecting material extending laterally between each two adjacent bags attached to and doubled over one of the flaps.

15. A chain of laterally interconnected bags constructed in accordance with claim 14 wherein said strip is frangible between bags.

16. A chain of laterally interconneted bags according to claim 1:

wherein the bottom edges of the bags are separated for filling;

a reinforcing rib extending along the bottom of the bags;

and frangible links interconnecting the bags in alignment with the reinforcing rib.

17. A chain of laterally interconnected bags constructed in accordance with claim 1, wherein said strip material extends along the chain formed by the plurality of bags, and an enlarged, thickened rib extends along said strip material.

* * * * *

UNITED STATES PATENT AND TRADEMARK OFFICE

CERTIFICATE OF CORRECTION

PATENT NO. : 4,630,311

DATED : December 16, 1986

INVENTOR(S) : Per Bentsen

It is certified that error appears in the above—identified patent and that said Letters Patent is hereby corrected as shown below:

Item [75] should read --Inventor: Per Bentsen, Suffern N.Y.

Column 1, line 20 "drawings" should read --drawing--

Column 1, line 25, "re" should read --Re--

Column 2, line 34, "is" should read --in--

Column 3, line 3, "Fig. 2" should read --Fig. 1--

Column 3, line 53, "e" should read --be--

Column 5, line 62, "pullaport" should read --pullapart--

In the Abstract, line 3, "element" should read --elements--

Signed and Sealed this

Twenty-seventh Day of October, 1987

*Attest:*

DONALD J. QUIGG

*Attesting Officer*

*Commissioner of Patents and Trademarks*